US010858827B2

(12) United States Patent
Hou et al.

(10) Patent No.: US 10,858,827 B2
(45) Date of Patent: Dec. 8, 2020

(54) BUCKLING-RESTRAINED BRACE WITH FLAT ENERGY DISSIPATION ELEMENT, BUILDING AND ASSEMBLY METHOD

(71) Applicant: SHANDONG UNIVERSITY, Jinan (CN)

(72) Inventors: Hetao Hou, Jinan (CN); Shaoyuan Zhang, Jinan (CN); Xiang Han, Jinan (CN); Zhihao Du, Jinan (CN); Xiaofang Liu, Jinan (CN)

(73) Assignee: SHANDONG UNIVERSITY, Jinan (CN)

( * ) Notice: Subject to any disclaimer, the term of this patent is extended or adjusted under 35 U.S.C. 154(b) by 0 days.

(21) Appl. No.: 16/488,273

(22) PCT Filed: Jun. 26, 2018

(86) PCT No.: PCT/CN2018/092741

§ 371 (c)(1),
(2) Date: Aug. 23, 2019

(87) PCT Pub. No.: WO2019/019849

PCT Pub. Date: Jan. 31, 2019

(65) Prior Publication Data

US 2020/0011051 A1 Jan. 9, 2020

(30) Foreign Application Priority Data

Jul. 25, 2017 (CN) ..... 2017 1 0610894
Jul. 25, 2017 (CN) ..... 2017 2 0905575 U

(51) Int. Cl.
*E04B 1/98* (2006.01)
*E04G 23/02* (2006.01)
(Continued)

(52) U.S. Cl.
CPC ..... *E04B 1/98* (2013.01); *E04G 23/02* (2013.01); *E04B 2001/2415* (2013.01);
(Continued)

(58) Field of Classification Search
CPC ..... E04H 9/02; E04H 9/027; E04H 9/021; E04B 1/98; E04B 2001/2442; E04G 25/04
See application file for complete search history.

(56) References Cited

U.S. PATENT DOCUMENTS 8,763,320 B1 * 7/2014 Chou ..... E04B 1/98 52/167.3
2006/0253057 A1 * 11/2006 Qi ..... E04C 3/04 602/23
(Continued)

FOREIGN PATENT DOCUMENTS

CN 101509282 A 8/2009
CN 201687219 U 12/2010
(Continued)

OTHER PUBLICATIONS

Aug. 29, 2018 International Search Report issued in International Patent Application No. PCT/CN2018/092741.
(Continued)

*Primary Examiner* — Christine T Cajilig
(74) *Attorney, Agent, or Firm* — Oliff PLC

(57) ABSTRACT

A buckling-restrained brace with a flat energy dissipation element, a building with the brace and an assembly method of the brace belongs to the field of force-resisting members of structural engineering. The brace includes a telescopic inner restrained member, an outer restrained member sleeved outside the inner restrained member, and the flat energy dissipation element between the inner and outer restrained members; the inner restrained member includes a first and a second steel square tube which are connected; the
(Continued)

flat energy dissipation element includes four flat fuses, and two ends of each fuse are connected to four sides of the first and second steel square tube by bolts; and the inner section of the outer restrained member is square, the outer restrained member covers the flat energy dissipation element, and a certain gap is disposed between the outer restrained member and the flat energy dissipation element.

17 Claims, 9 Drawing Sheets

(51) Int. Cl.

| | |
|---|---|
| ***E04B 1/24*** | (2006.01) |
| ***E04G 25/04*** | (2006.01) |
| ***E04H 9/02*** | (2006.01) |

(52) U.S. Cl.
CPC ..... *E04B 2001/2442* (2013.01); *E04B 2001/2448* (2013.01); *E04G 25/04* (2013.01); *E04H 9/024* (2013.01)

(56) References Cited

U.S. PATENT DOCUMENTS

| | | | | |
|---|---|---|---|---|
| 2008/0016794 | A1* | 1/2008 | Tremblay | E04H 9/02 52/167.4 |
| 2013/0139452 | A1* | 6/2013 | Tsai | E04B 1/1903 52/167.3 |
| 2014/0059950 | A1 | 3/2014 | Marinovic et al. | |
| 2017/0016504 | A1* | 1/2017 | Braun | E04H 9/02 |

FOREIGN PATENT DOCUMENTS

| | | | | |
|---|---|---|---|---|
| CN | 206309097 | U | 7/2017 | |
| CN | 107476459 | A | 12/2017 | |
| CN | 207032556 | U | 2/2018 | |
| KR | 101403178 | B1 | 6/2014 | |
| TW | 201116678 | A | 5/2011 | |
| WO | WO-2016068401 | A1 * | 5/2016 | E04B 1/38 |
| WO | WO-2017054323 | A1 * | 4/2017 | E04B 1/98 |

OTHER PUBLICATIONS

Aug. 29, 2018 Written Opinion issued in International Patent Application No. PCT/CN2018/092741.

* cited by examiner

BUCKLING-RESTRAINED BRACE WITH FLAT ENERGY DISSIPATION ELEMENT, BUILDING AND ASSEMBLY METHOD

FIELD OF THE INVENTION

The present invention relates to the technical field of force-resisting members of structural engineering, in particular to a buckling-restrained brace with a flat energy dissipation element, a building and an assembly method.

BACKGROUND OF THE INVENTION

In a multistoried or high-rise building steel structure system, a frame is the most basic unit. A brace enables the steel frame to have higher lateral resisting stiffness and strength, so as to reduce the lateral displacement of the frame during earthquake and avoid or reduce the damage to non-structural members. A buckling-restrained brace overcomes the disadvantages of compressive buckling of common braces, and offers enhanced energy absorption capability, reduced difference in tensile and compression resistances and ease of computer modeling.

After the 1994 Northridge Earthquake and the 1995 Kobe Earthquake, the use of buckling-restrained brace substantially increased in new buildings and seismic retrofits of existing construction. Moreover, various types of high-performance buckling-restrained brace have been proposed. However, the existing types of ordinary buckling-restrained brace have the following limitations:

1) Cumbersome disassembly and replacement: an energy dissipation element of the buckling-restrained brace needs to dissipate energy from an earthquake. The energy dissipation will inevitably cause damage or rupture of the energy-dissipation element, so the energy dissipation-seismic effect of the buckling-restrained brace may be greatly compromised in the aftershocks or subsequent earthquakes. For the existing buckling-restrained brace, in particular to the buckling-restrained brace using mortar or other brittle non-metallic filling material filled in steel tubes to realize a buckling restrained mechanism, after a major earthquake, if the damage to the energy dissipation element needs to be detected, an outer restrained member needs to be disassembled, which is troublesome to operate and can also cause the damage to the brace. Even if special technical means prove that it is necessary to replace the damaged buckling-restrained brace, the removal of the existing buckling-restrained brace and the installation of the new buckling-restrained brace may be onerous for many reasons, for example, limited workspace at the buckling-restrained brace ends, especially when the gusset plates connecting the buckling-restrained brace to the frame is completely or partially obstructed by a ceiling or other non-structural members. In addition, many existing common buckling-restrained braces are connected with the gusset plates of the connecting frames through welding seams, so that it is necessary to apply secondary welding on the gusset plates for replacing the whole braces. It is difficult to perform the secondary welding and ensure the quality. Furthermore, the thermal effect generated by welding can affect the mechanical properties of the gusset plates and reduce the bearing capacity and fatigue performance of the new braces.

2) Poor reusability: a buckling-restrained brace with reasonable design should control the damage in the constrained yielding segments of the energy dissipation element, while the buckling restraining members should always remain elastic. However, the buckling restraining members in many traditional buckling-restrained braces are very low in reusability, which does not help achieve the sustainable design objective.

SUMMARY OF THE INVENTION

The present invention discloses a buckling-restrained brace with a flat energy dissipation element which is simple to disassemble and replace, and can reuse buckling restraining members conveniently, a building and an assembly method.

In order to solve the above technical problems, the present invention provides the following technical scheme:

In one aspect, the present invention discloses a buckling-restrained brace with a flat energy dissipation element, which is used as a brace for a frame and includes a telescopic inner restrained member, an outer restrained member sleeved outside the inner restrained member, and the flat energy dissipation element between the inner restrained member and the outer restrained member, wherein, the inner restrained member includes a first steel square tube and a second steel square tube with the same length and outer section, the first steel square tube and the second steel square tube are connected, and the far ends of the first steel square tube and the second steel square tube are connected with the frame;

the flat energy dissipation element includes four flat fuses, and two ends of each of the four flat fuses are connected to the four sides of the first steel square tube and the second steel square tube by bolts, two slots/notches are formed in the middle part of each of the flat fuses for forming weakened yielding segments, and the two ends are non-weakened non-yielding segments; and the inner section of the outer restrained member is square, the outer restrained member covers the flat energy dissipation element, and a certain gap is disposed between the outer restrained member and the flat energy dissipation element.

Further, a stiffener is disposed on the outer surface of each yielding segment longitudinally, and the outer restrained member is connected with the stiffener through the bolts.

Further, the first steel square tube and the second steel square tube have the same size, the first steel square tube and the second steel square tube are connected by a male-male adaptor, the male-male adaptor is a steel square tube, a stiffener which is arranged outside surface and perpendicular to the planes of the steel square tubes are arranged at the middle part of the male-male adaptor, the outer section of the male-male adaptor is smaller than the inner section of the first steel square tube, one end of the male-male adaptor is welded with or plugged into the first steel square tube, and the other end is plugged into the second steel square tube.

Further, each of the first steel square tube and the second steel square tube is 100-5000 mm long, the spacing between the first steel square tube and the second steel square tube is 20-500 mm, the gap between the outside surface of the male-male adaptor and the inside surface of the second steel square tube is 1-10 mm, and the male-male adaptor plugged into the second steel square tube is 20-800 mm long.

Further, bolt holes for connection of the first steel square tube with the second steel square tube are formed in the outer side parts of the non-yielding segments, each non-yielding segment includes an unrestrained connection segment provided with the bolt holes, an unrestrained non-yielding segment not provided with the bolt holes and not covered with the outer restrained member, and a restrained non-yielding segment not provided with the bolt holes but covered with the outer restrained member, the outer restrained member covers the yielding segments and the restrained non-yielding segments, and the yielding segments are restrained yielding segments restrained by the inner restrained member and the outer restrained member.

Further, the non-weakened non-yielding segments are arranged at the middle parts of the flat fuses for forming middle restrained non-yielding segments, the length of each of the middle restrained non-yielding segments is larger than the spacing between the first steel square tube and the second steel square tube when the buckling-restrained brace deforms due to a maximum design tension capacity, and the stiffeners are arranged on the middle restrained non-yielding segments; and end stiffeners are arranged on the outer surfaces of the restrained non-yielding segments and the unrestrained non-yielding segments longitudinally.

Further, the outer restrained member is formed by buckling four W-shaped steel plates, the adjacent W-shaped steel plates are connected by the bolts, the gap between the outer restrained member and the flat energy dissipation element is 1-5 mm, and the gap is filled with a debonding material.

Further, a round hole is formed in the middle part of the stiffener, two oblong holes are formed beside the round hole, the bolts between the adjacent two W-shaped steel plates pass through the round hole and the oblong holes, and a washer is arranged between the adjacent two W-shaped steel plates; and transition regions between the adjacent two segments of the restrained non-yielding segments, the restrained yielding segments and the middle restrained non-yielding segments are arc lines, straight lines or straight lines and arc lines.

In a further aspect, the present invention provides a building comprising the above buckling-restrained brace with the flat energy dissipation element.

In still a further aspect, the present invention further discloses an assembly method of the above buckling-restrained brace with the flat energy dissipation element, including:

step 1: welding or plugging one end of the male-male adaptor to or into the first steel square tube, and inserting the other end into the second steel square tube to form the inner restrained member;

step 2: welding the stiffener and the end stiffener to the outer surface of the flat energy dissipation element longitudinally, adjusting the spacing between the first steel square tube and the second steel square tube, and connecting the unrestrained connection segments of the flat energy dissipation element to the first steel square tube and the second steel square tube;

step 3: connecting the middle stiffener of the flat energy dissipation element with the adjacent two W-shaped steel plates through the bolts, and then connecting the adjacent two W-shaped steel plates by the bolts.

The present invention has the following beneficial effects:

Compared with the prior art, in the buckling-restrained brace with the flat energy dissipation element of the present invention, the inner restrained member and the flat energy dissipation element are connected through bolts and thus offer ease of assembly and disassembling, and the posteearthquake detection for damage to the flat energy dissipation element and replacement of the damaged flat energy dissipation element. When the buckling-restrained brace with the flat energy dissipation element is installed, the first steel square tube and the second steel square tube of the inner restrained member are connected, then the four flat fuses are connected to four sides of the first steel square tube and the second steel square tube by the bolts, and finally, the outer restrained member is wrapped on the outside of the flat fuses. When in tension or compression, the damage can be concentrated at the yielding segments of the flat fuses, the inner restrained member and the outer restrained member still remain elastic after the earthquake and can be reused, only the flat fuses need to be replaced, and then the buckling-restrained brace can restore the energy dissipation-seismic function.

DETAILED DESCRIPTION OF THE INVENTION

In order to enable the technical problems, the technical schemes, and the advantages of the present invention to be clearer, the present invention will be described in detail in conjunction with the drawings and the specific embodiments.

Figure 8:
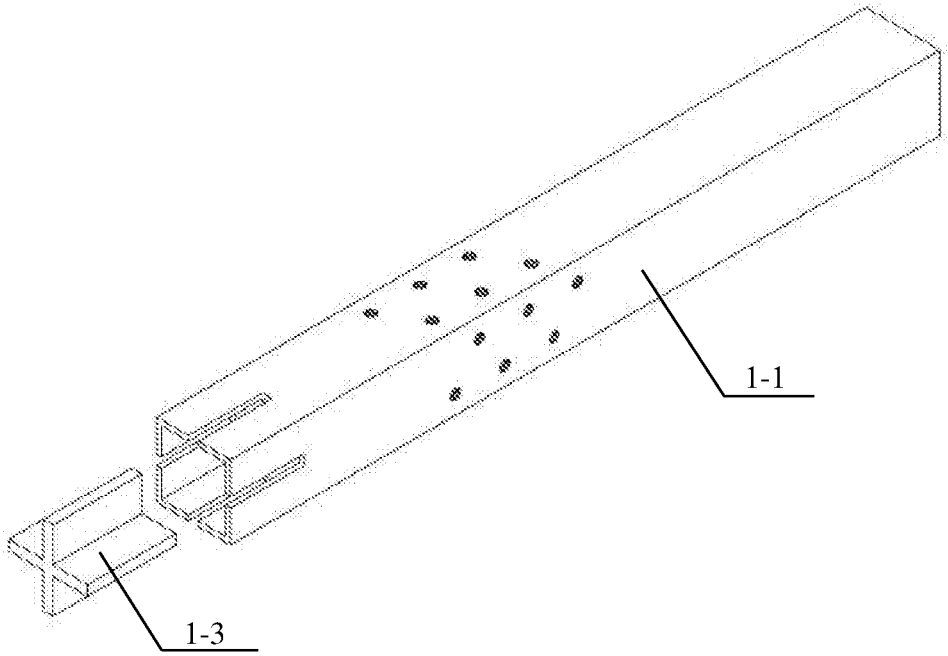
FIG. 8 is a schematic view illustrating the structure of a first steel square tube of the inner restrained member of the present invention.

In one aspect, the present invention discloses a buckling-restrained brace with a flat energy dissipation element, which is used as a brace for a frame, as shown in FIG. 1 to FIG. 16. The buckling-restrained brace comprises a telescopic inner restrained member 1, an outer restrained member 2 sleeved outside the inner restrained member 1, and the flat energy dissipation element between the inner restrained member 1 and the outer restrained member 2, wherein, the inner restrained member 1 comprises a first steel square tube 1-1 and a second steel square tube 1-2 with the same length and outer section, the first steel square tube 1-1 and the second steel square tube 1-2 are connected, the far ends of the first steel square tube 1-1 and the second steel square tube 1-2 are connected with the frame, specifically, elongated slots can be formed all around the outer end of the first steel square tube 1-1 or the second steel square tube 1-2 and connected with the gusset plate of the frame through a connecting plate 1-3 or directly. As shown in FIG. 8, the section of each connecting plate 1-3 is crisscross, the crisscross connecting plate 1-3 is welded at the outer end of each of the first steel square tube 1-1 and the second steel square tube 1-2, the first steel square tube 1-1 and the second steel square tube 1-2 of the inner restrained member 1 can move relatively in the axis direction of the brace; after the installation, it needs to be ensured that when the buckling-restrained brace deforms due to a maximum design compression resistance, the near ends with the same outer section of the first steel square tube 1-1 and the second steel square tube 1-2 are not in contact with each other, and when it deforms due to a maximum design tension capacity, the near ends of the first steel square tube 1-1 and the second steel square tube 1-2 cannot depart from each other; it is worth noting that, under the condition of tensile and compressive forces, the first steel square tube 1-1 and the second steel square tube 1-2 can also be rectangular tubes or steel tubes in other segment shapes; those skilled in the art can select flexibly without affecting the inventiveness of the present invention; and in addition, the maximum design tensile/compression resistance of the present invention is designed by those skilled in the art according to the loading features of the specific frame.

The flat energy dissipation element includes four flat fuses 3, and two ends of each of the four flat fuses 3 are connected to the four sides of the first steel square tube 1-1 and the second steel square tube 1-2 by bolts, respectively, the bolts here can be blind hole bolts meeting the design requirements or high-strength bolts with screw rods long enough, or the like, bolt holes are formed in the first steel square tube 1-1 and the second steel square tube 1-2 according to design positions and sizes; on the same side, the bolt holes can be arranged in parallel or staggered, openings of the bolt holes can neither cause mutual influence of the bolts, nor affect the relative motion of the first steel square tube 1-1 and the second steel square tube 1-2, the openings in the two parallel sides can be arranged in the same way, the openings in the two perpendicular sides can be staggered, and the specific arrangement can be determined according to the actually adopted bolts.

Two slots/notches 4 are formed in the middle part of each of the flat fuses 3 for forming weakened yielding segments 3-1, and two ends of the flat fuse are non-weakened non-yielding segments 3-2.

The inner section of the outer restrained member 2 is square, the outer restrained member covers the flat energy dissipation element 3, and a certain gap is disposed between the outer restrained member 2 and the flat energy dissipation element.

Compared with the prior art, the inner restrained member and the flat energy dissipation element of the buckling-restrained brace with the flat energy dissipation element are connected through bolts and thus offer ease of assembly and disassembling, and the postearthquake detection for damage to the flat energy dissipation element and replacement of the damaged flat energy dissipation element. When the buckling-restrained brace with the flat energy dissipation element is installed, the first steel square tube and the second steel square tube of the inner restrained member are connected, then the four flat fuses are connected on the four sides of the first steel square tube and the second steel square tube by the bolts, and finally, the outer restrained member covers the flat energy dissipation element. When in tension or compression, the damage can be concentrated at the yielding segments of the flat fuses, the inner restrained member and the outer restrained member still remain elastic after the earthquake and can be reused, only the flat fuses need to be replaced, and then the energy dissipation-seismic function of the buckling-restrained brace can be restored.

Figure 1:
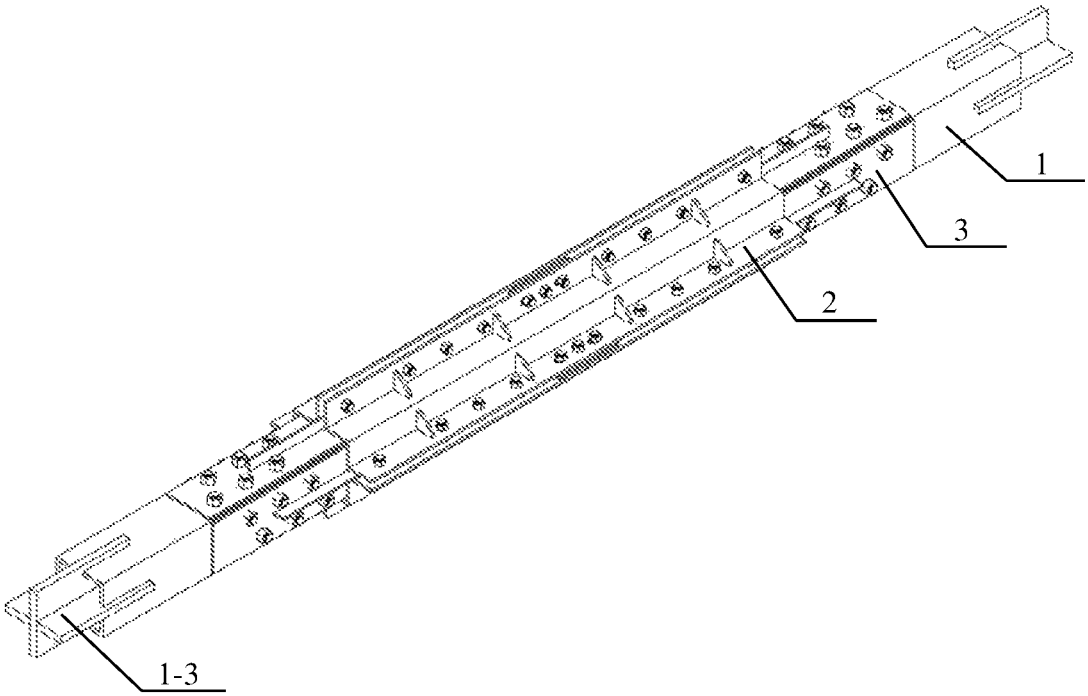
FIG. 1 is a schematic view illustrating the overall structure of a buckling-restrained brace with a flat energy dissipation element of the present invention.
Figure 2:
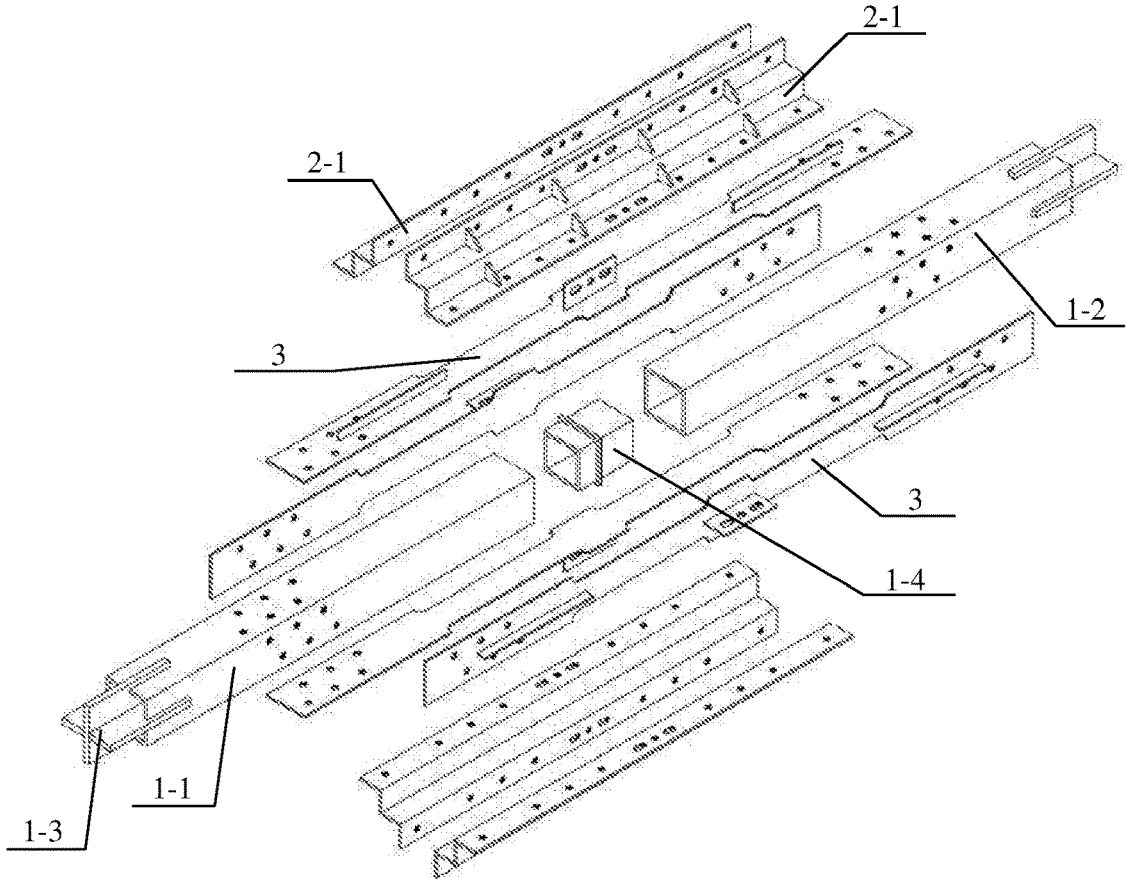
FIG. 2 is an explored view illustrating the parts of the buckling-restrained brace with the flat energy dissipation element of the present invention.
Figure 3:
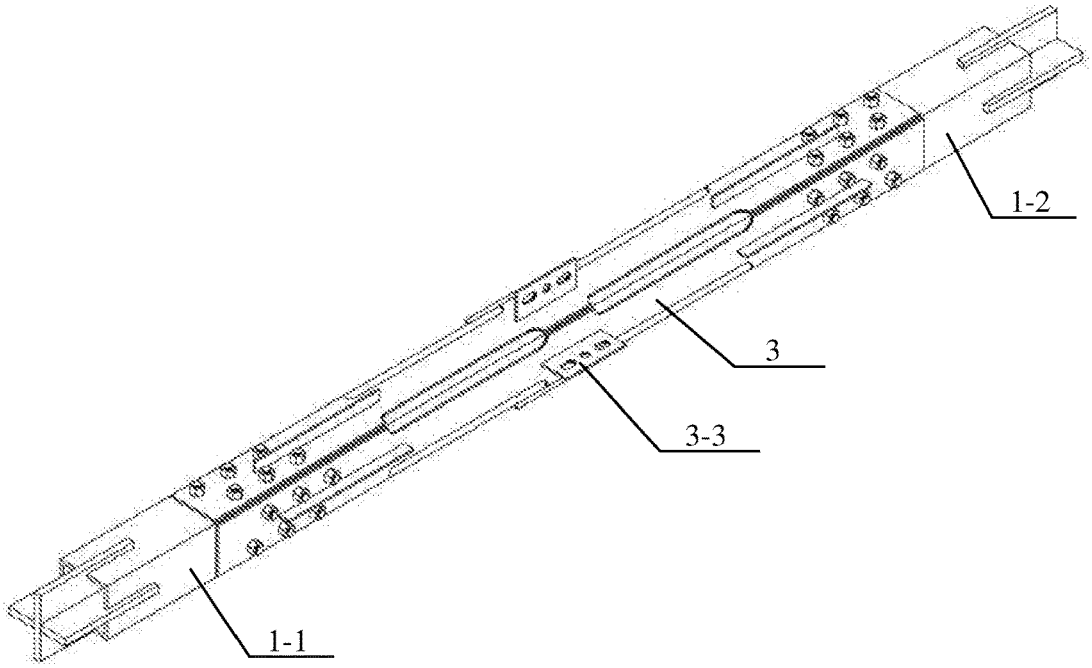
FIG. 3 is a schematic view illustrating the connection between the flat energy dissipation element and an inner restrained member of the present invention.
Figure 4:
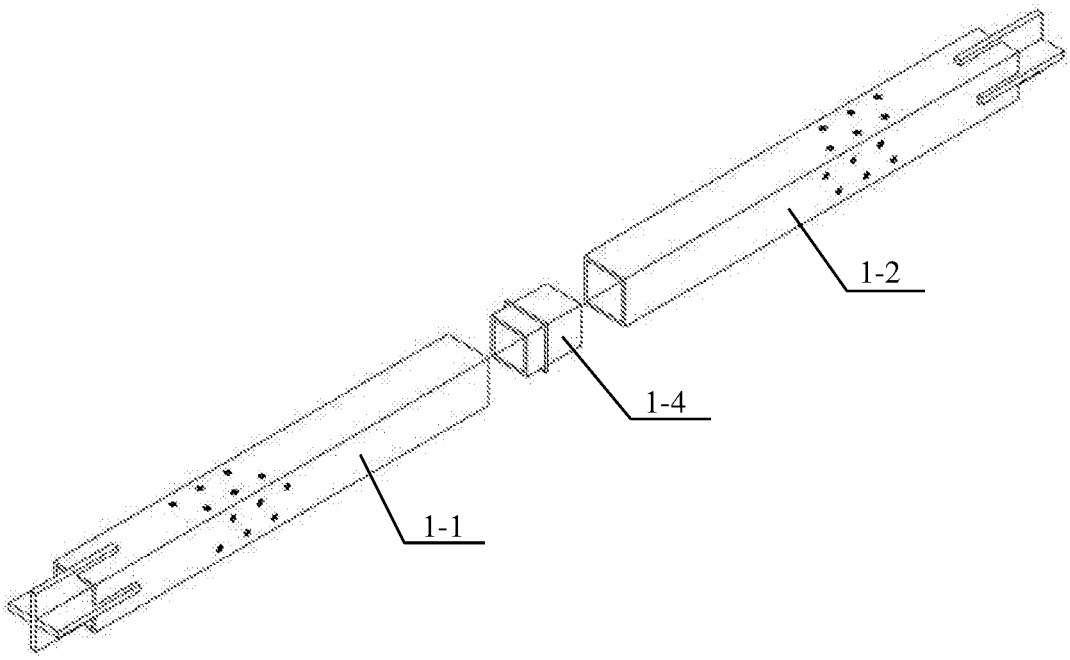
FIG. 4 is a schematic view illustrating a first embodiment of the inner restrained member of the present invention.
Figure 5:
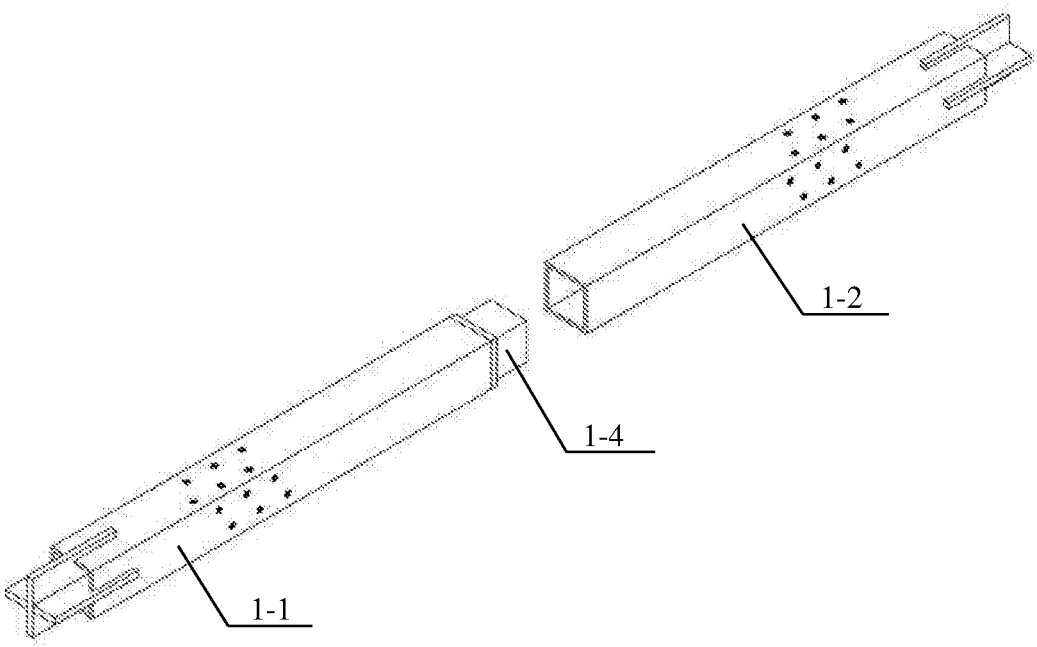
FIG. 5 is a schematic view illustrating a second embodiment of the inner restrained member of the present invention.
Figure 6:
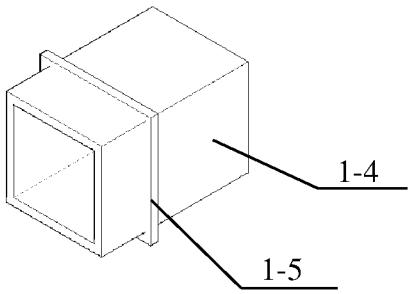
FIG. 6 is a schematic view illustrating the structure of a male-male adaptor of the inner restrained member of the present invention.
Figure 7A:
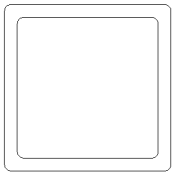
FIGS. 7(*a*)-7(*e*) are schematic views illustrating the composition form of the male-male adaptor of the inner restrained member of the present invention.
Figure 7B:
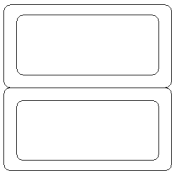
Figure 7C:
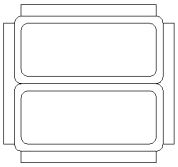
Figure 7D:
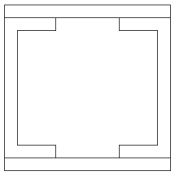
Figure 7E:
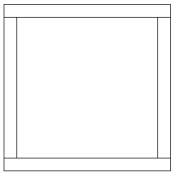
Figure 9:
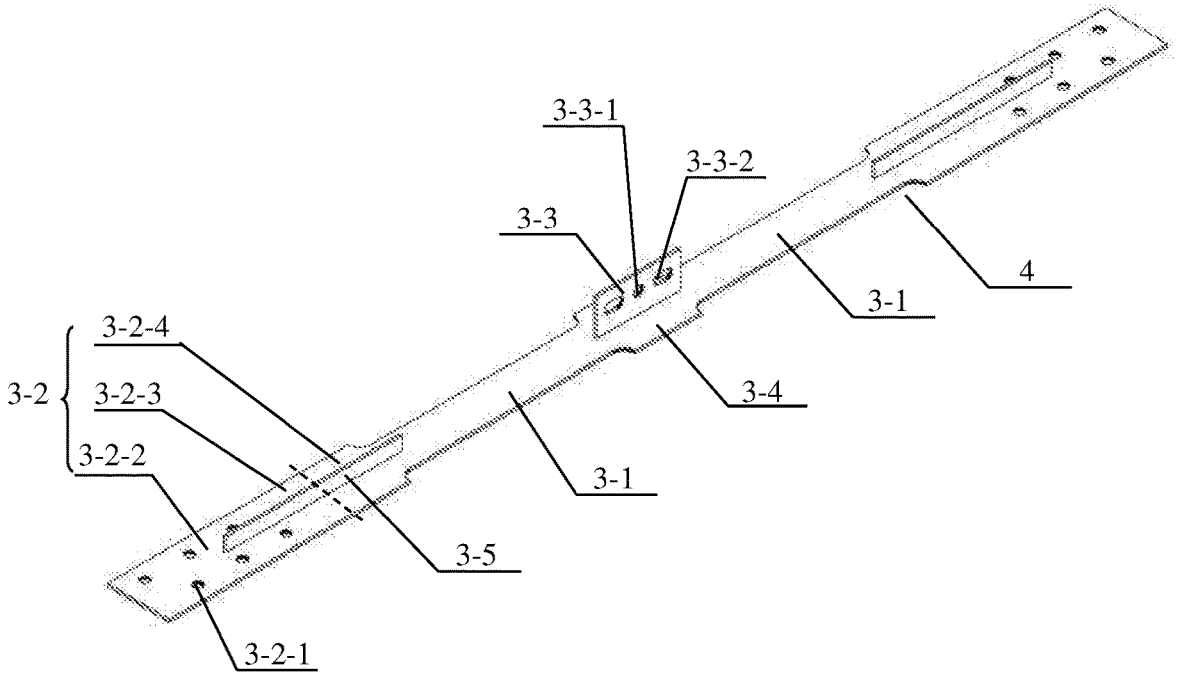
FIG. 9 is a perspective view illustrating a flat fuse of the present invention.
Figure 10:
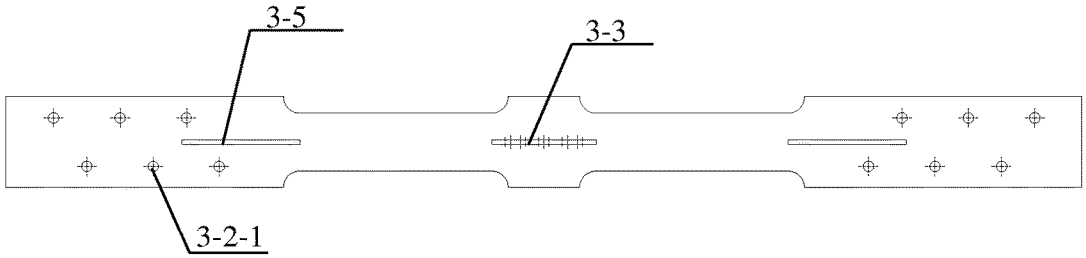
FIG. 10 is a top view of FIG. 9.
Figure 11:
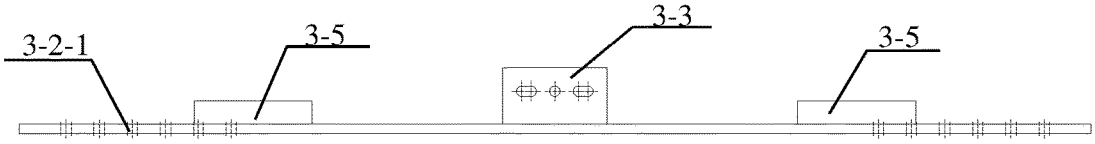
FIG. 11 is a side view of FIG. 9.
Figure 12A:
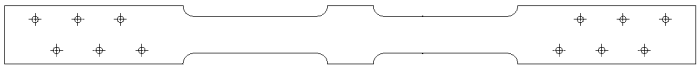
FIGS. 12(*a*)-12(*d*) are schematic views illustrating different structural forms of the flat fuse of the present invention.
Figure 12B:
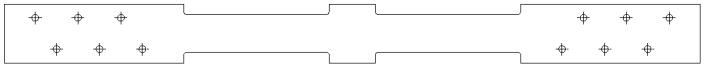
Figure 12C:
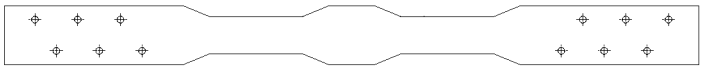
Figure 12D:
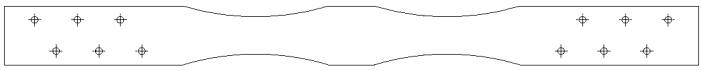
Figure 13A:
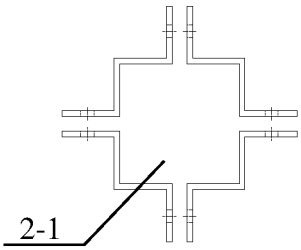
FIGS. 13(*a*) and 13(*b*) are sectional schematic views of the first embodiment of the outer restrained member of the present invention, wherein, (a) is a sectional schematic view of buckling of four W-shaped steel plates, and (b) is a sectional schematic view of the single W-shaped steel plate.
Figure 13B:
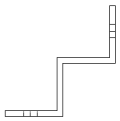

Further, as shown in FIG. 9, a stiffener 3-3 is disposed on the outer surface of the yielding segment 3-1 longitudinally, the outer restrained member 2 is connected to the stiffener 3-3 through the bolts, the stiffener 3-3 can not only restrain the inward buckling of the flat fuse under the action of pressure of the brace, but also prevent sliding of the outer restrained member 2 relative to the flat energy dissipation element. Further, the first steel square tube 1-1 and the second steel square tube 1-2 are preferably the same (i.e., the same length, thickness and outer section), and are made of the same material. As shown in FIGS. 4-6, the first steel square tube 1-1 and the second steel square tube 1-2 are connected through a male-male adaptor 1-4, the male-male adaptor 1-4 is a steel square tube, one end of the male-male adaptor 1-4 is welded to or plugged into the first steel square tube 1-1, and the other end is plugged into the second steel square tube 1-2; when the male-male adaptor 1-4 is plugged into the first steel square tube 1-1, a stiffener 1-5 which is arranged on the outside surface and perpendicular to the planes of the steel square tubes is preferably arranged at the middle part of the male-male adaptor 1-4 (not required during welding) so as to prevent sliding of the male-male adaptor 1-4 into the first steel square tube 1-1 or the second steel square tube 1-2; it is worth noting that, the outer dimension of the stiffener 1-5 does not exceed the outermost dimension of the first steel square tube 1-1 or the second steel square tube 1-2, so that the installation of the flat energy dissipation element is not affected; the outer section of the male-male adaptor 1-4 is smaller than the inner sections of the first steel square tube 1-1 and the second steel square tube 1-2, thereby not only ensuring that the second steel square tube 1-2 and the male-male adaptor 1-4 can slide freely relative to each other, but also ensuring that the first steel square tube 1-1 and the second steel square tube 1-2 have a relatively effective inner restrained effect on the flat energy dissipation element.

Preferably, the first steel square tube 1-1 and the second steel square tube 1-2 may be 100-5000 mm long, and the spacing between the first steel square tube 1-1 and the second steel square tube 1-2 is 20-500 mm after the installation, namely the distance between the near ends of the first steel square tube 1-1 and the second steel square tube 1-2 needs to meet the maximum design tensile/compression resistance deformation requirements of the buckling-restrained brace; the gap between the outside surface of the male-male adaptor 1-4 and the inside surface of the second steel square tube 1-2 is preferably 1-10 mm so as to ensure that the male-male adaptor 1-4 and the second steel square tube 1-2 can slide freely; and the first male-male adaptor 1-4 plugged into the second steel square tube 1-2 is preferably 20-800 mm long, so as to prevent the male-male adaptor 1-4 from departing from the second steel square tube 1-2 when the buckling-restrained brace is in tension.

It should be noted that, as shown in FIG. 7, the steel square tube of the male-male adaptor 1-4 can be a steel tube which is integrally formed, formed by welding two square tubes or formed by welding steel plates and section steel or formed in a variety of forms, as long as the design requirements are met.

Preferably, as shown in FIG. 9, bolt holes 3-2-1 for connection of the first steel square tube 1-1 with the second steel square tube 1-2 are formed in the outer sides of the non-yielding segments 3-2. Each non-yielding segment 3-2 includes an unrestrained connection segment 3-2-2 provided with the bolt holes 3-2-1, an unrestrained non-yielding segment 3-2-3 not provided with the bolt holes 3-2-1 and not covered with the outer restrained member 2, and a restrained non-yielding segment 3-2-4 not provided with the bolt holes 3-2-1 but covered with the outer restrained member 2. The outer restrained member 2 covers the yielding segments 3-1 and the restrained non-yielding segments 3-2-4, the dotted line in FIG. 9 is a position where the outer restrained member 2 covers the flat fuse 3, the unrestrained non-yielding segment 3-2-3 is arranged on the left of the dotted line, the restrained non-yielding segment 3-2-4 is arranged on the right of the dotted line, and the yielding segments 3-1 are restrained yielding segments restrained by the inner restrained member 1 and the outer restrained member 2. It is worth noting that each restrained non-yielding segment 3-2-4 should be long enough so as to be not free of the restraint of the outer restrained member 2 completely when the buckling-restrained brace deforms due to a maximum design tension capacity; and the length of each unrestrained non-yielding segment 3-2-3 should be appropriate so as to ensure that there is still a distance between the ends of the unrestrained connection segment 3-2-2 and the outer restrained member 2 when the buckling-restrained brace deforms due to a maximum design compression resistance.

As an improvement of the present invention, as the male-male adaptor 1-4 has small section and a poor restraint effect at the spacing between the first steel square tube 1-1 and the second steel square tube 1-2 of the inner restrained member 1, the non-weakened non-yielding segment is preferably arranged at the middle part of the yielding segment of the flat fuse 3 for forming a middle restrained non-yielding segment 3-4, the length of the middle restrained non-yielding segment 3-4 is larger than the spacing between the first steel square tube 1-1 and the second steel square tube 1-2 when the buckling-restrained brace deforms due to the maximum design tension capacity, a stiffener 3-3 is arranged on the middle restrained non-yielding segment 3-4, and the stiffener 3-3 also increases the strength of the middle restrained non-yielding segment 3-4; the middle restrained non-yielding segment 3-4 and the stiffener 3-3 are arranged to reduce the stress intensity and damage degree of concentration of the liner energy dissipation element at the male-male adaptor 4 and control the plastic deformation at the restrained yielding segments; and end stiffeners 3-5 are arranged on the outer surface of the restrained non-yielding segment 3-2-4 and the unrestrained non-yielding segment 3-2-3 longitudinally to avoid the local buckling at the restrained non-yielding segments 3-2-4 and the unrestrained non-yielding segments 3-2-3, the end stiffeners 3-5 preferably extend to the unrestrained connection segments 3-2-2, and the height of the end stiffener 3-5 should not be too high to touch the bolts for connecting the outer restrained member 2.

Each flat fuse 3 sequentially includes the unrestrained connection segment 3-2-2, the unrestrained non-yielding segment 3-2-3, the restrained non-yielding segment 3-2-4, the restrained yielding segment, the middle restrained non-yielding segment 3-4, the restrained yielding segment, the restrained non-yielding segment 3-2-4, the unrestrained non-yielding segment 3-2-3 and the unrestrained connection segment 3-2-2 from one end to the other end; when each flat fuse 3 is processed, a flat plate is cut at first, then the stiffener 3-3 and two end stiffeners 3-5 are welded, the stiffener 3-3 and the end stiffeners 3-5 preferably remain on the same straight line, the end stiffeners 3-5 are welded to the restrained non-yielding segments 3-2-4 and the unrestrained non-yielding segments 3-2-3, preferably, the end stiffeners 3-5 can appropriately extend to the unrestrained connection segments 3-2-2 without affecting the screwing of the bolts, and welding seams of the end stiffeners 3-5 preferably do not extend to the restrained yielding segments so as to prevent residual thermal deformation from affecting the strength, the fatigue resistance and the damage resistance of the flat energy dissipation element.

In the present invention, the outer restrained member 2 is preferably formed by buckling four W-shaped steel plates 2-1, and the adjacent W-shaped steel plates 2-1 are connected by the bolts so as to offer ease of disassembling. The gap between the outer restrained member 2 and the flat energy dissipation element is 1-5 mm, the gap is preferably filled with a debonding material, which can be lubricating oil, soft glass or Teflon material or the like, and can also be selected flexibly as the case may be, and the debonding material can reduce the friction force between the flat energy dissipation element and the inner restrained member 1 and between the flat energy dissipation element and the outer restrained member 2 when the high-order buckling deformation of the flat energy dissipation element occurs.

Figure 16A:
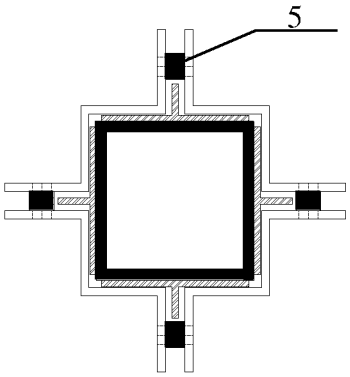
FIGS. 16(*a*)-16(*c*) are sectional schematic views of the first embodiment of the outer restrained member of the present invention after the completion of assembly, wherein, (a) is a corresponding sectional schematic view at an end stiffener, (b) is a corresponding sectional view at a stiffener, and (c) is a corresponding sectional schematic view at parts with no stiffener.
Figure 16:
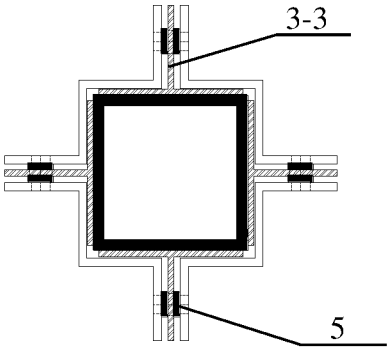
Figure 16:
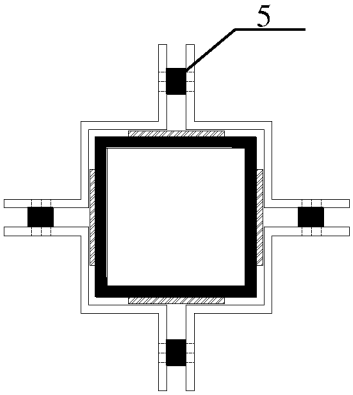

As another improvement of the present invention, a round hole 3-3-1 is formed in the middle part of the stiffener 3-3, two oblong holes 3-3-2 are formed beside the round hole 3-3-1, and the bolts between the adjacent two W-shaped steel plates 2-1 pass through the round hole 3-3-1 and the oblong holes 3-3-2 so as to prevent outward buckling deformation of the flat energy dissipation element between the bolt holes on the W-shaped steel plates 2-1 and prevent the outer restrained member 2 from partially bearing a relatively large axial force. The flat fuses 3 are connected with the outer restrained member 2 through the round hole 3-3-1 and the oblong holes 3-3-2 of the stiffener 3-3, so as to prevent inward buckling deformation of the flat energy dissipation element and also prevent large relative sliding of the outer restrained member 2 and the flat energy dissipation element, during the bolted connection, at the corresponding segment of each stiffener 3-3, the bolts sequentially pass through the W-shaped steel plate 2-1, the stiffener 3-3 and the W-shaped steel plate 2-1, if the height of weld legs of the stiffener 3-3 or the end stiffeners 3-5 of the flat fuse 3 is relatively high, proper washers 5 can be increased at the two ends of the middle stiffener, as shown in FIG. 16(*b*); the proper washers 5 can be added or reduced at the end stiffeners, as shown in FIG. 16(*a*), the bolts sequentially pass through the W-shaped steel plate 2-1, the washers 5 and the W-shaped steel plate 2-1; and the washer 5 can also be arranged at the parts with no stiffener, as shown in FIG. 16(*c*).

Figure 14A:
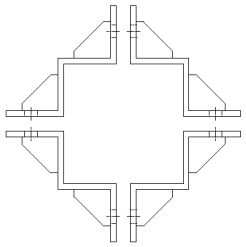
FIGS. 14(*a*) and 14(*b*) are sectional schematic views of the second embodiment of the outer restrained member of the present invention, wherein, (a) is a sectional schematic view of buckling of four W-shaped steel plates, and (b) is a segmental schematic view of the single W-shaped steel plate.
Figure 14B:
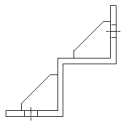
Figure 15A:
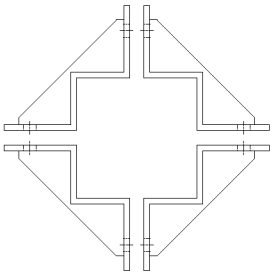
FIGS. 15(*a*) and 15(*b*) are sectional schematic views of the third embodiment of the outer restrained member of the present invention, wherein, (a) is a sectional schematic view of buckling of four W-shaped steel plates, and (b) is a sectional schematic view of the single W-shaped steel plate.
Figure 15B:
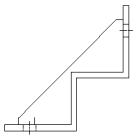

It is worth noting that the W-shaped steel plates 2-1 in the outer restrained member 2 can be formed by cold bending the steel plates and can also be formed by welding the steel plates or the section steel, of the thickness of the W-shaped steel plates 2-1 needs to ensure that no partial buckling occurs at the maximum pressure, and it is also conceivable to add the proper stiffeners on the W-shaped steel plates 2-1 to improve the strength of the outer restrained member, as shown in FIGS. 14 and 15.

Further, as shown in FIG. 12, there are various types of flat fuses 3, and transition regions between the adjacent two segments of the restrained non-yielding segments 3-2-4, the restrained yielding segments and the middle restrained non-yielding segments 3-4 are arc lines, straight lines or a combination thereof.

In a further aspect, the present invention provides a building including the above buckling-restrained brace with the flat energy dissipation element. As the structure is the same as the structure above, it will not be repeated herein.

In still a further aspect, the present invention further provides an assembly method of the above buckling-restrained brace with the flat energy dissipation element, including:

Step 1: welding or plugging one end of the male-male adaptor 1-4 to or into the first steel square tube 1-1 (during welding, prefabricated in a factory), and plugging the other end into the second steel square tube 1-2 to form the inner restrained member 1, wherein the spacing distance between the first steel square tube 1-1 and the second steel square tube 1-2 and the distance of the male-male adaptor 1-4 plugged into the second steel square tube 1-2 need to meet the maximum design tensile/compression resistance deformation requirements of the buckling-restrained brace;

step 2: welding the stiffener 3-3 and the end stiffeners 3-5 to the outer surface of the flat energy dissipation element longitudinally (preferably, processing of the stiffener 3-3 and the end stiffeners 3-5 is finished in the factory), adjusting the spacing between the first steel square tube 1-1 and the second steel square tube 1-2, and connecting the unrestrained connection segments 3-2-2 of the flat energy dissipation element to the first steel square tube 1-1 and the second steel square tube 1-2;

step 3: connecting the stiffener 3-3 of the flat energy dissipation element between the adjacent two W-shaped steel plates 2-1 through the bolts, and then connecting the adjacent two W-shaped steel plates 2-1 by the bolts.

The buckling-restrained brace with the flat energy dissipation element of the present invention undergoes performance tests according to Shanghai Engineering Construction Standard "Code for design of high-rise building steel structures"(DG/TJ08-32-2008) (referred to as Shanghai high steel code), "Code for seismic design of buildings" (GB50011-2010) (referred to as seismic code), Shanghai Recommended Application Standard of Building Products, "Application technology code for TJ buckling-restrained braces" (DBFCT105-2011) (referred to as TJ restrained brace code) and "Technical specification for seismic energy dissipation of buildings" (JGJ297-2013) (referred to as energy dissipation code), and the tests are specifically as follows:

In the seismic code, the net length of the brace is defined as L; in the Shanghai high steel code and the TJ restrained brace code, strength degradations of the test pieces are required to be not more than 15% in three tensile and compressive tests at the displacement amplitudes of L/300, L/200, L/150 and L/100 in sequence; and in the seismic code, the energy dissipation code and the TJ restrained brace code, strength degradations of the test pieces are required to be not more than 15% in 30 cycles at the displacement amplitude of L/150.

TABLE 1

| Number of test pieces | Total length of two yielding segments (mm) | Width of yielding segments (mm) | Debonding material | Steel model | CPD | Maximum compression/tension ratio β |
|---|---|---|---|---|---|---|
| A1 | 910 | 90 | Lubricating oil | Q235 | 1127 | 1.214 |
| A2 | 910 | 90 | Lubricating oil | Q235 | 1535 | 1.258 |
| A3 | 870 | 70 | Lubricating oil | Q235 | 1382 | 1.215 |
| A4 | 1020 | 90 | Lubricating oil | Q235 | 821 | 1.244 |
| A5 | 910 | 90 | Lubricating oil | Q235 | 2859 | 1.170 |
| A6 | 910 | 90 | Lubricating oil | Q235 | 931 | 1.169 |

The basic parameters of the buckling-restrained brace with the flat energy dissipation element are listed in Table 1. In the tests, it was assumed that the total length of the restrained yielding segments was 0.50 times the length of the brace. 30 cycles of constant amplitude loading with the displacement amplitude corresponding to L150 and incremental loading (increased once every three circles) with the displacement amplitudes sequentially corresponding to L/300, L/200, L/150 and L/100 were sequentially applied to the test piece A5. In constant amplitude loading, the tensile strength degradation was 3.5% and the compressive strength met the requirement of being within 15%. In the variable amplitude loading process, no obvious (more than 15%) strength and stiffness degradation occurred, meeting the requirements of the code.

In Table 1, the cumulative plastic deformation (CPD) of each test piece was calculated according to the American Standard AISC 341-16 (AISC 2016), and the cumulative plastic deformation of each test piece exceeded the suggested lower limit 200 given in AISC 341-16(AISC 2016), wherein the CPD of the test piece A5 reached 2859.

In Table 1, the maximum compression/tension ratio β of each test piece was less than the upper limit 1.3 specified by AISC 341-16, being in line with the requirements of the code.

Figure 17:
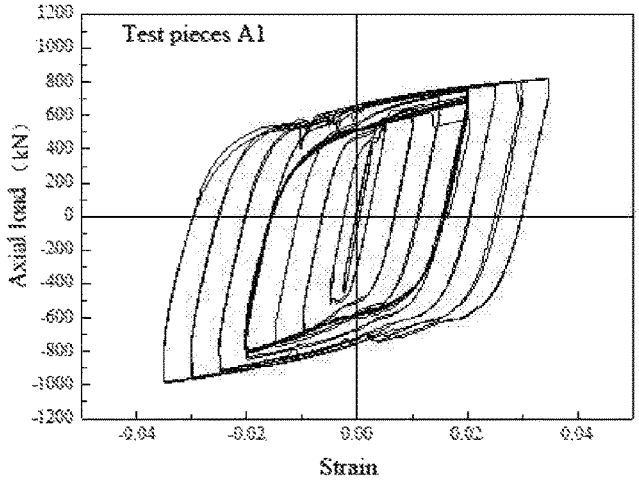
FIGS. 17(*a*)-17(*f*) show hysteretic curves of test pieces A1 to A6.
Figure 17:
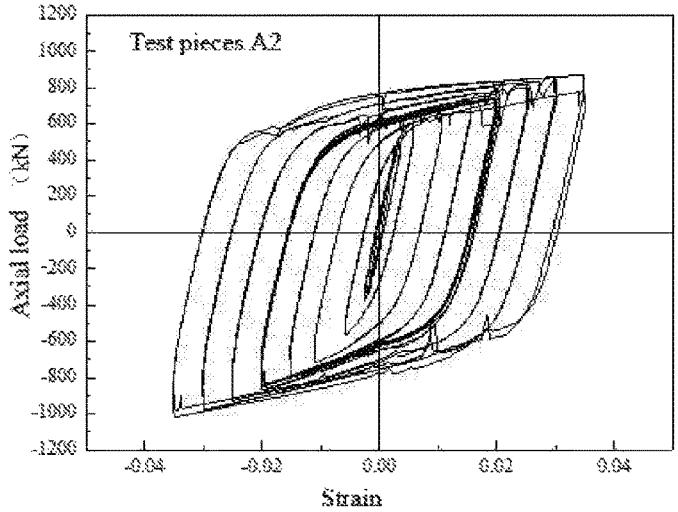
Figure 17:
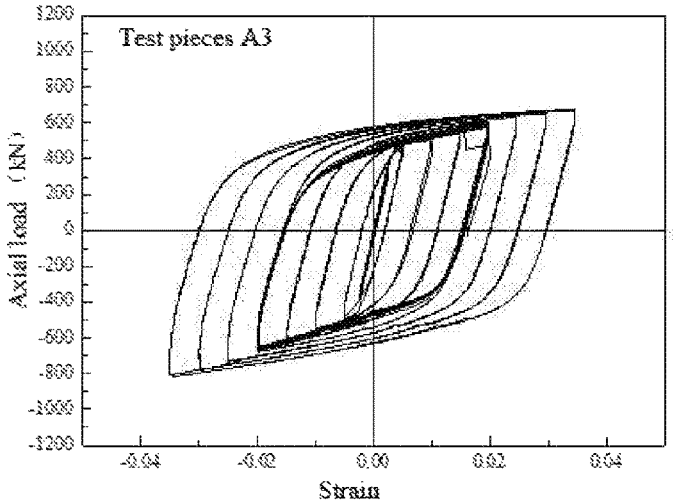
Figure 17:
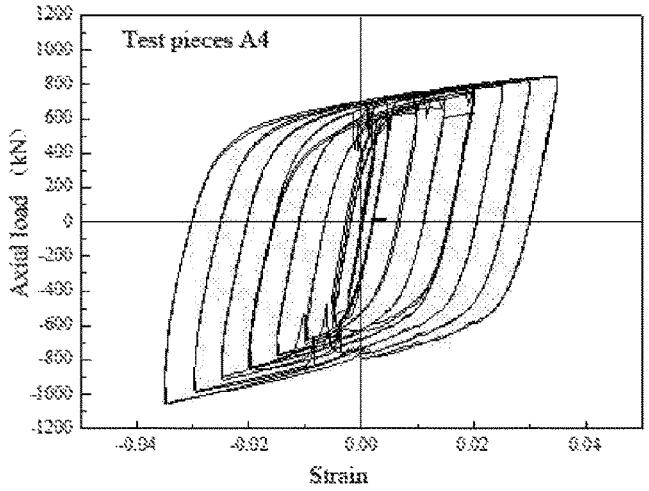
Figure 17:
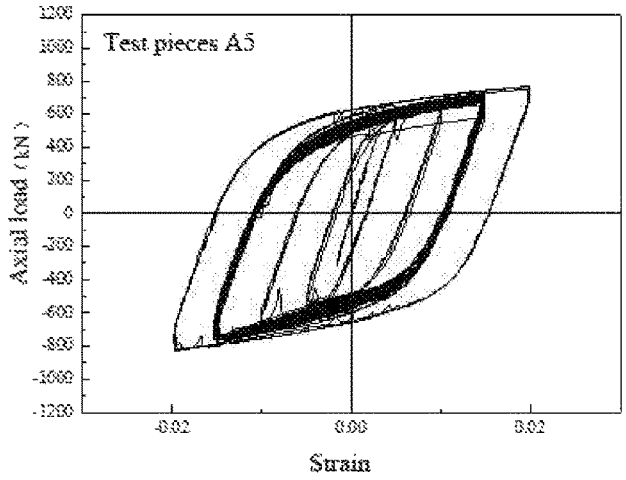
Figure 17:
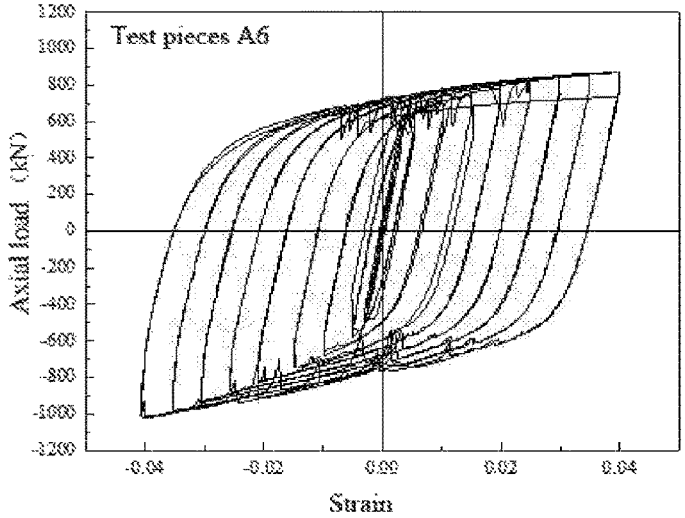

Furthermore, hysteretic curves obtained according to the parameters of the test pieces in Table 1, as shown in FIGS. 17(*a*)-(*f*), are the hysteretic curves of the test pieces A1-A6 respectively. It can be seen that the hysteretic curves of the test pieces are relatively full without overall buckling, showing the similar stable hysteretic performance. In addition, the inner restrained member and the outer restrained member were recycled in the test pieces A1-A6 in the above test researches and no significant damage occurred at all.

The above is a preferred embodiment of the present invention. It should be noted that, those skilled in the art can also make a number of improvements and modifications without departing from the principles of the present invention, and the improvements and modifications should also be regarded as being within the protection scope of the present invention.

The invention claimed is:

1. A buckling-restrained brace with a flat energy dissipation element used as a brace for a frame, the buckling-restrained brace comprising a telescopic inner restrained member, an outer restrained member sleeved outside the inner restrained member, and the flat energy dissipation element between the inner restrained member and the outer restrained member, wherein, the inner restrained member comprises a first steel square tube and a second steel square tube with the same length and outer section, the first steel square tube and the second steel square tube are connected by insertion, and far ends of the first steel square tube and the second steel square tube are configured to be connected with the frame;

the flat energy dissipation element comprises four flat fuses, and two ends of each of the four flat fuses are connected to four sides of the first steel square tube and the second steel square tube by bolts, respectively, two slots/notches are formed in a middle part of each of the flat fuses for forming a weakened yielding segment, and the two ends are non-weakened non-yielding segments; and an inner section of the outer restrained member is square, the outer restrained member covers the flat energy dissipation element, and a certain gap is disposed between the outer restrained member and the flat energy dissipation element.

2. The buckling-restrained brace according to claim 1, wherein a stiffener is disposed on an outer surface of the yielding segment longitudinally, and the outer restrained member is connected with the stiffener through the bolts.

3. The buckling-restrained brace according to claim 2, wherein the first steel square tube and the second steel square tube have the same size, the first steel square tube and the second steel square tube are connected by a male-male adaptor, the male-male adaptor is a steel square tube, a stiffener which is arranged outside surface and perpendicular to the planes of the steel square tubes arranged at a middle part of the male-male adaptor, an outer section of the male-male adaptor is smaller than an inner section of the first steel square tube, one end of the male-male adaptor is welded or plugged into the first steel square tube, and an other end is plugged into the second steel square tube.

4. The buckling-restrained brace according to claim 3, wherein each of the first steel square tube and the second steel square tube is 100-5000 mm long, a spacing between the first steel square tube and the second steel square tube is 20-500 mm, a gap between the outside surface of the male-male adaptor and the inside surface of the second steel square tube is 1-10 mm, and the male-male adaptor plugged into the second steel square tube is 20-800 mm long.

5. The buckling-restrained brace according to claim 1, wherein bolt holes for connection of the first steel square tube with the second steel square tube are formed in an outer side parts of the non-yielding segments; each non-yielding segment comprises an unrestrained connection segment provided with the bolt holes, an unrestrained non-yielding segment not provided with the bolt holes and not covered with the outer restrained member, and a restrained non-yielding segment not provided with the bolt holes but covered with the outer restrained member; the outer restrained member covers the yielding segments and the restrained non-yielding segments, and the yielding segments are restrained yielding segments restrained by the inner restrained member and the outer restrained member.

6. The buckling-restrained brace according to claim 5, wherein non-weakened non-yielding segments are arranged at the middle parts of the flat fuses for forming middle restrained non-yielding segments, a length of each of the middle restrained non-yielding segments is larger than a spacing between the first steel square tube and the second steel square tube when the buckling-restrained brace deforms due to a maximum design tension capacity, and a stiffener is arranged on the middle restrained non-yielding segments; and end stiffeners are arranged on the outer surfaces of the restrained non-yielding segments and the unrestrained non-yielding segments longitudinally.

7. The buckling-restrained brace according to claim 6, wherein the outer restrained member is formed by buckling four W-shaped steel plates, the adjacent W-shaped steel plates are connected by the bolts, a gap between the outer restrained member and the flat energy dissipation element is 1-5 mm, and the gap is filled with a debonding material.

8. The buckling-restrained brace according to claim 7, wherein a round hole is formed in a middle part of the stiffener, two oblong holes are formed beside the round hole, the bolts between the adjacent two W-shaped steel plates pass through the round hole and the oblong holes, and washers are arranged between the adjacent two W-shaped steel plates; and transition regions of the adjacent two segments of the restrained non-yielding segments, the restrained yielding segments and the middle restrained non-yielding segments are arc lines, straight lines or a combination thereof.

9. A building, comprising the buckling-restrained brace with the flat energy dissipation element according to claim 1.

10. An assembly method of the buckling-restrained brace with the flat energy dissipation element according to claim 8, comprising the following steps:

step 1: welding or plugging one end of a male-male adaptor to or into the first steel square tube, and plugging the other end into the second steel square tube to form the inner restrained member;

step 2: welding the stiffener and the end stiffeners to the outer surface of the flat energy dissipation element longitudinally, adjusting the spacing between the first steel square tube and the second steel square tube, and connecting the unrestrained connection segments of the flat energy dissipation element to the first steel square tube and the second steel square tube;

step 3: connecting the stiffener of the flat energy dissipation element with the adjacent two W-shaped steel plates through the bolts, and then connecting the adjacent two W-shaped steel plates by bolts.

11. A building, comprising the buckling-restrained brace with the flat energy dissipation element according to claim 2.

12. A building, comprising the buckling-restrained brace with the flat energy dissipation element according to claim 3.

13. A building, comprising the buckling-restrained brace with the flat energy dissipation element according to claim 4.

14. A building, comprising the buckling-restrained brace with the flat energy dissipation element according to claim 5.

15. A building, comprising the buckling-restrained brace with the flat energy dissipation element according to claim 6.

16. A building, comprising the buckling-restrained brace with the flat energy dissipation element according to claim 7.

17. A building, comprising the buckling-restrained brace with the flat energy dissipation element according to claim 8.

* * * * *